US005694841A

United States Patent [19]

Sato

[11] Patent Number: 5,694,841

[45] Date of Patent: Dec. 9, 1997

[54] DRUM SUPPORT STRUCTURE FOR A STENCIL PRINTER

[75] Inventor: Mitsuo Sato, Shibata-machi, Japan

[73] Assignee: Tohoku Ricoh Co., Ltd., Miyagi-ken, Japan

[21] Appl. No.: 572,863

[22] Filed: Dec. 14, 1995

[30] Foreign Application Priority Data

May 15, 1995 [JP] Japan ..... 7-116079

[51] Int. Cl.[6] ..... B41L 13/06

[52] U.S. Cl. ..... 101/116; 16/126; 101/120

[58] Field of Search ..... 101/116, 216, 101/117, 118, 119, 120; 16/126

[56] References Cited

U.S. PATENT DOCUMENTS

| | | | |
|---|---|---|---|
| 4,589,162 | 5/1986 | Manz et al. | 16/126 |
| 5,216,904 | 6/1993 | Isaki | 16/126 |
| 5,379,184 | 1/1995 | Barraza et al. | 16/126 |
| 5,507,225 | 4/1996 | Noguchi et al. | 101/116 |
| 5,537,920 | 7/1996 | Hasegawa et al. | 101/119 |

FOREIGN PATENT DOCUMENTS

| | | |
|---|---|---|
| 59-12894 | 1/1984 | Japan . |
| 61-85462 | 6/1986 | Japan . |
| 62-28758 | 6/1987 | Japan . |
| 5-229243 | 9/1993 | Japan . |

*Primary Examiner*—Edgar S. Burr
*Assistant Examiner*—Daniel J. Colilla
*Attorney, Agent, or Firm*—Oblon, Spivak, McClelland, Maier & Neustadt, P.C.

[57] ABSTRACT

In a stencil printer, a drum support structure has a drum unit including a handle. The handle can be raised when released from a drum support member mounted on the printer or can be folded down when coupled with the drum support member. Therefore, the structure miniaturizes the printer with a simple configuration. Further, the structure allows a drum of the drum unit to move stably when the drum unit is moved into and out of the printer, thereby protecting a master wrapped around the drum from damage.

9 Claims, 8 Drawing Sheets

DRUM SUPPORT STRUCTURE FOR A STENCIL PRINTER

BACKGROUND OF THE INVENTION

1. Field of the Invention

The present invention relates to a printer and, more particularly, to a drum support structure for a stencil printer.

2. Discussion of the Background

While various types of printers are available for printing document images on sheets, a stencil printer using a thermosensitive stencil is extensively used due to its quantity printing capability. The stencil printer has an ink drum provided with a structure permeable to ink. A stencil perforated in accordance with a document image, i.e., a master is wrapped around the drum. An ink supply mechanism is disposed in the drum for supplying ink to the drum. When a sheet is pressed against the drum, the ink is transferred from the drum to the sheet via the perforations of the master, thereby printing the document image on the sheet. This kind of printer is extremely economical because it can continuously produce a great number of printings with a single master.

In the stencil printer, the drum is moved when it should be replaced with another drum for multicolor printing or when a sheet jamming a path adjoining the drum should be removed. Specifically, the drum is movable between an operative position where the ink can be transferred to the sheet via the drum, and an inoperative position where the drum is pulled out of the printer. Drum support structures for allowing the drum to be removably mounted to the printer body are disclosed in, e.g., Japanese Patent Publication No. 62-28758 and Japanese Utility Model Laid-Open Publication No. 61-82462.

However, the conventional drum support structures have some issues yet to be solved, as follows. To begin with, because it is difficult to reduce the dimension of the drum unit in the vertical direction, the overall dimension of the printer cannot be reduced. Further, because it is difficult to stabilize the behavior of the drum unit when the drum suspended from the drum unit is moved, it is likely that the master wrapped around the drum contacts a master making section and a master discharging section adjoining the drum and is damaged or dislocated thereby.

SUMMARY OF THE INVENTION

It is therefore an object of the present invention to provide a drum support structure for a stencil printer, and capable of miniaturizing the printer with a simple configuration.

It is another object of the present invention to provide a drum support structure for a stencil printer, and capable of protecting a master wrapped around a suspended drum from damage by stabilizing the behavior of the drum when the drum is in movement.

In accordance with the present invention, in a stencil printer having a cylindrical drum movable between an operative position where it performs printing via a master wrapped therearound and by being supplied with ink, and an inoperative position where it is pulled out of the operative position, a dram support structure has a drum support member mounted on the body of the stencil printer, and for movably supporting the drum. A drum unit rotatably supports the drum, and has an engaging portion partly engageable with the drum support member, and a foldable handle provided in the engaging portion.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
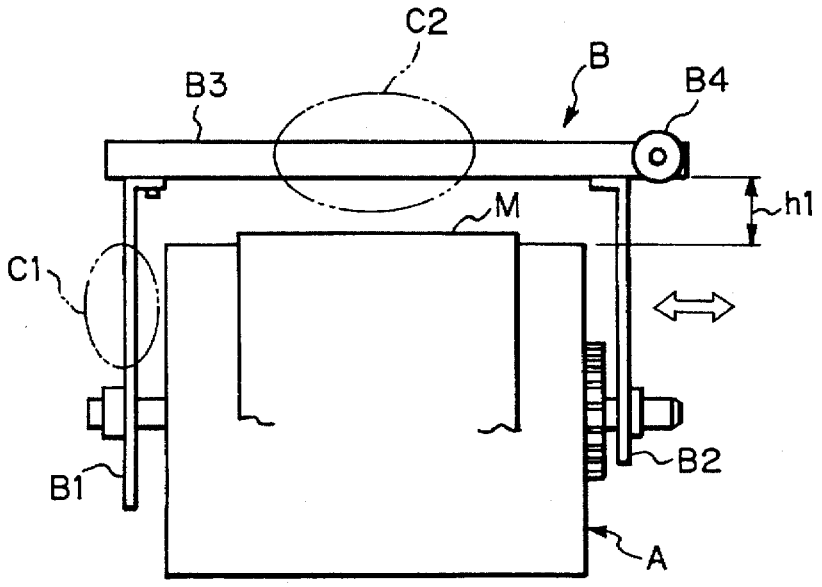
Fig. 1 PRIOR ART
FIG. 1 shows a drum unit included in a conventional stencil printer.

To better understand the present invention, a brief reference will be made to a conventional drum support structure of the type allowing a print drum to be moved and taught in previously mentioned Japanese Utility Model Laid-Open Publication No. 61-85462. As shown in FIG. 1, the support structure has a drum unit B including an ink drum A. Side plates B1 and B2 extend downward from a top plate B1. The drum A is journalled to the side plates B1 and B2 at axially opposite ends thereof. A pair of rollers B4 are mounted on the top plate B3 and rollably received in a guide rail E (see FIG. 3) which is disposed in the body of a stencil printer. Specifically, the top plate B3 is received in the guide rail E (see FIG. 3), so that the drum unit B is suspended from the printer body. In this condition, the drum unit B is movable in the dual direction of the dram A between an operative position received in the printer body and an inoperative position pulled out of the same.

The drum A must be easy to pull out and carry when, e.g., it is replaced for multicolor printing. In order to enhance portability, a part of the side plate B1 plays the role of a grip C1 for pulling out the drum A to the inoperative position, while a part of the top plum B3 plays the role of a grip C2 for carrying the drum A.

The above conventional structure has various problems left unsolve, as follows. To begin with, it is difficult to reduce the dimension of the drum unit B in the vertical direction. Specifically, as shown in FIG. 1, the grip C2 used to carry the drum unit B should preferably positioned at the center of the unit B in the lengthwise direction, so that the weight may be balanced in the axial direction of the drum A. The grip C2 is therefore located above and at the center in the axial direction of the drum A. It follows that the distance h1 between the surface of the drum A and the grip C2 must be great enough to prevent the operator's hand put under the grip C2 from touching the drum A. The distance h1 is usually selected to be about 35 mm to about 45 mm.

Figure 2:
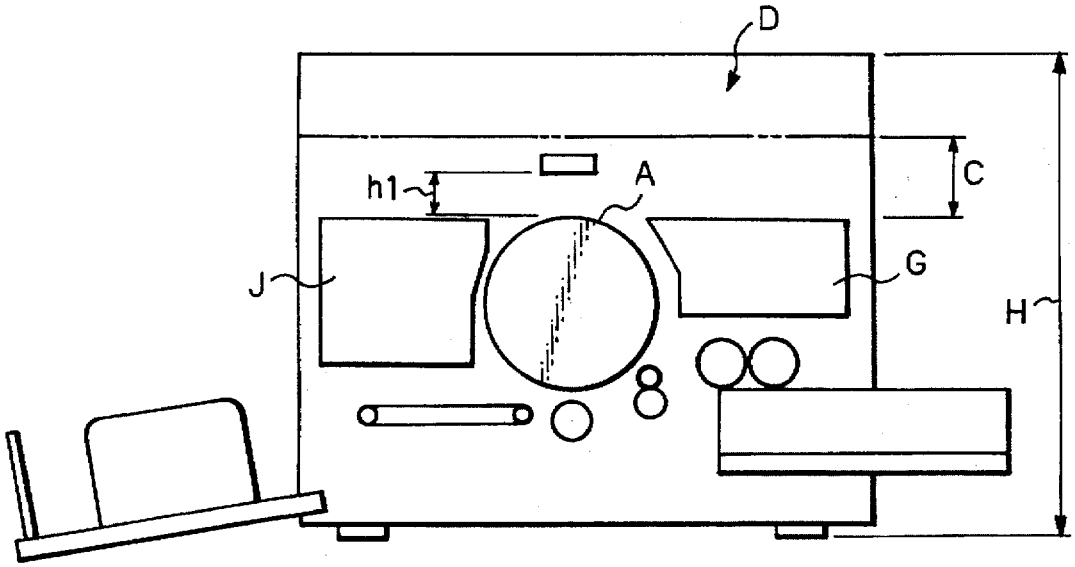
Fig. 2 PRIOR ART
FIG. 2 shows the general construction of a stencil printer to which the drum unit of FIG. 1 is mounted.

As shown in FIG. 2, the printer has an image reading section D above the drum A. A stencil is perforated in accordance with image data read by the reading section D. The above distance h1 between the grip C2 and the surface of the drum A effects the overall height H of the printer. That is, an increase in the distance h1 results in an increase in the distance C between the bottom of the reading section D and the drum A, and therefore in the overall height of the printer. This prevents the printer from being reduced in size.

Figure 3:
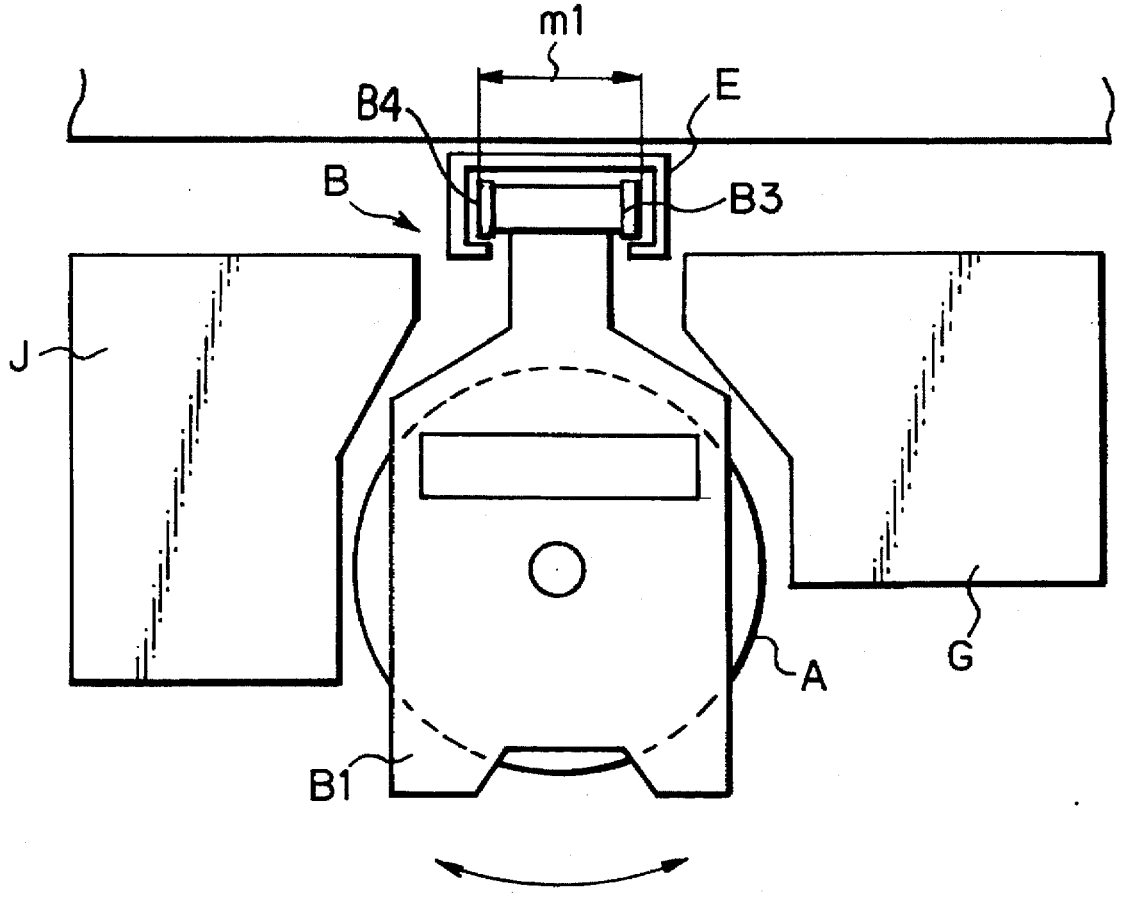
Fig. 3 PRIOR ART
FIG. 3 is a side elevation demonstrating a problem particular to the drum unit of FIG. 1.

Another problem with the conventional structure is that it is difficult to cause the drum A to move stably when pulled out of the printer body. As shown in FIG. 3, the drum unit B supporting the drum A is suspended From the guide rail E with the rollers B4 rollably received in the guide rail E. In this condition, the drum unit B tends to swing to opposite sides about the guide rail B. Particularly, when the guide rail E and top plate B3 have a width ml which is relatively small and far smaller than the diameter of the drum A, the drum unit B swing easily. As a result, as shown in FIG. 3, a master M (see FIG. 1) wrapped around the drum A is apt to contact a master making section G and a master discharging section J which adjoin the drum A. When the master M contacts these sections G and J, it is damaged or dislocated. Moreover, when the drum unit B is moved by the operator, a force greater than the weight of the unit B acts on the unit B and causes the unit B to swing more easily than when the unit B is simply suspended due to its own weight. This aggravates the probability that the drum A contacts the members adjoining it.

Figure 4:
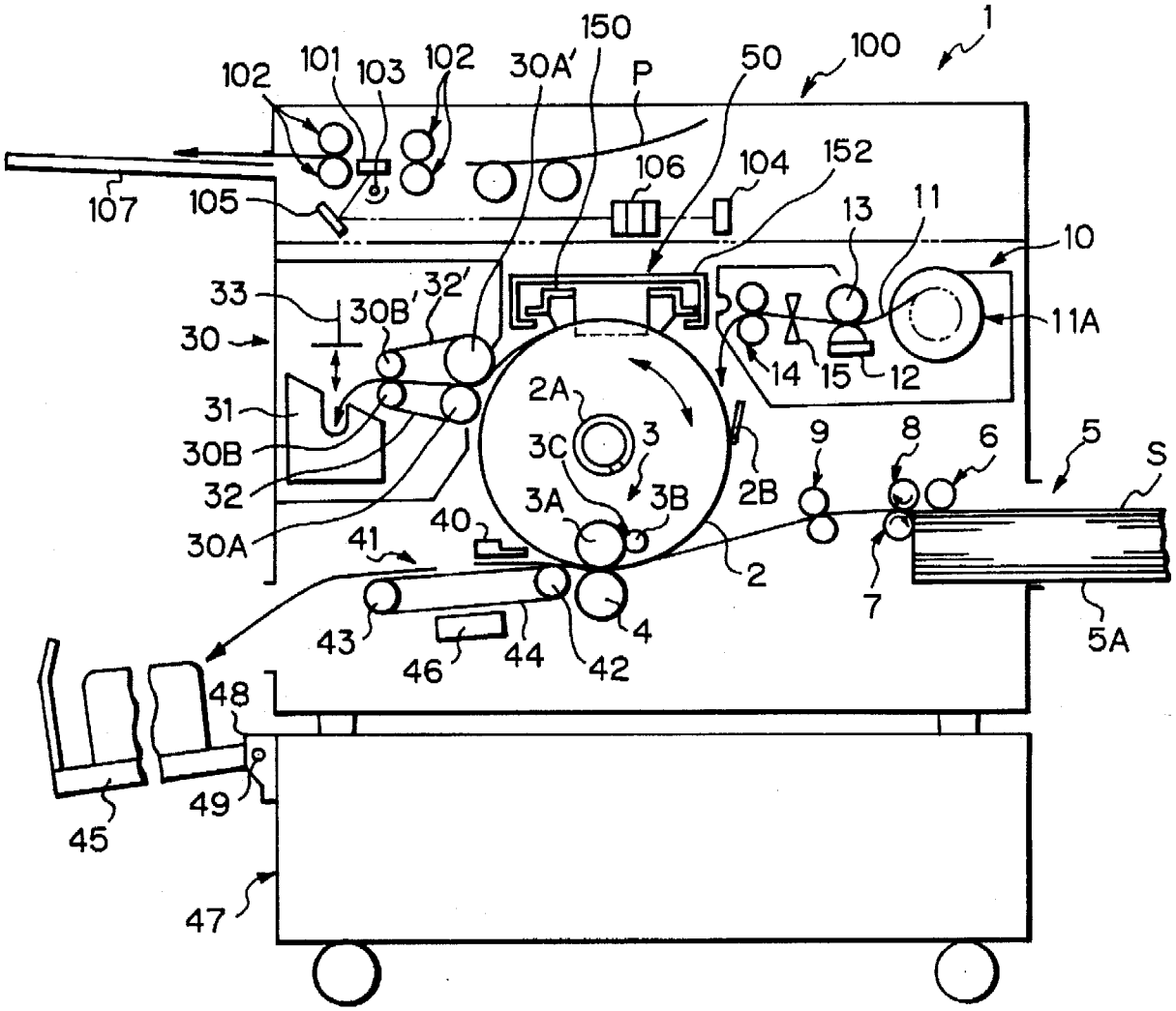
FIG. 4 shows the general construction of a stencil printer to which the present invention is applied.

Referring to FIG. 4, the general construction of a stencil printer to which the present invention is applicable is shown. As shown, the printer, generally 1, has an ink drum 2 rotatable in opposite directions about a shaft 2A. The drum 2 is rotated clockwise during the course of printing or counterclockwise when a master wrapped therearound is to be removed. The drum 2 is formed with a number of perforations except for a part thereof and is covered with a thin mesh screen, not shown. The mesh screen is implemented by, e.g., synthetic fibers although it may be implemented by metal, if desired. A clamper 28 is positioned in the part of the drum 2 where the perforations are absent. The clamper 2B is made up of a stale formed of a magnetic material and including a surface extending along one generating line of the drum 2, and a clamping member pivotable toward and away from the stage. When the leading edge of a master is laid on the above surface of the stage, the clamping member clamps it in cooperation with the stage. The portion of the master following the leading edge adheres to the drum surface due to ink fed from an ink supply mechanism 3, which will be described, to the surface of the drum 2.

The ink supply mechanism 3 is disposed in the drum 2 substantially beneath the shaft 2A. The mechanism 3 mainly consists of a metallic ink roller 3A and a doctor roller 3B. The ink roller 3A is positioned below the shaft 2A and races a press roller 4 which will be described. The roller 3A is rotated at a peripheral speed synchronous to the peripheral speed of the drum 2 while contacting the inner periphery of the drum 2. As a result ink regulated in amount by the doctor roller 3B is fed by the roller 3A to the perforations of the drum 2 and those of the mesh screen. Specifically, the ink is dropped from a hole formed in the shaft 2A into a wedge-shaped space or ink well 3C defined between the rollers 3A and 3B. When the press roller 4 is pressed against the drum 2, the roller 3A plays the role of a back-up roller for preventing the drum 2 from being deformed by the roller 4.

The press roller 4 is movable into and out of contact with the drum 2. When a sheet S is fed from a sheet feeding device 5 to the drum 2, the roller 4 presses it against the surface of the drum 2 with the intermediary or a master 11 wrapped around the drum 2. As a result, the ink is transferred from the drum 2 to the sheet via the perforations of the master 11. In this sense, the roller 4 constitutes an image transfer station.

The sheet feeding device 5 is located in the vicinity of the press roller 4 and has a tray 5A loaded with a stack of sheets S, a pick-up roller 6, separation rollers 7 and 8, and a registration toiler pair 9 which are sequentially arranged in the intended direction of sheet feed. The sheet feed direction corresponds to the direction indicated by an arrow in FIG. 4. The pick-up roller 6 is movable into contact with the uppermost sheet S of the stack and drives it in the sheet feed direction. The separation rollers 7 and 8 face each other with the intermediary of the path for the transport of the sheet S. These rollers 7 and 8 are each rotatable in the direction for preventing the sheet or sheets S underlying the uppermost sheet S from being fed at the same time. The registration roller pair 9 once stops the movement of the sheet S and then drives it at a predetermining timing toward the image transfer station where the press toiler 4 contacts the drum 2. Specifically, the roller pair 9 nips the leading edge of the sheet S, and then feeds it toward the image transfer station at such a timing that the print start position on the sheet S meets the image position of the master 11. This timing is based on the. time when the press roller 4 is brought into contact with the drum 2.

A master making section 10 is located above and at one side of the axis of the drum 2. A stencil, also designated by the reference numeral 11, is stored in the section 10 and implemented as a roll wound round a core 11A. The core 11A has flanges at both ends thereof. The stencil 11 has a laminate structure consisting of a thermoplastic resin film which is as thin as 1 μm to 2 μm, and a porous substrate adhered to the resin film. The substrate may be comprised of Japanese paper or synthetic fibers or a combination thereof. The stencil 11 is perforated by the heat of a thermal head 12 which will be described. The stencil 11 paid out from the roll is pressed against the head 12 by a platen roller 13. Heating elements included in the head 12 are selectively caused to generate heat, thereby perforating the stencil 11 in the main scanning and subscanning directions. It is to be noted that the main scanning direction is the axial direction of the platen roller 13 while the subscanning direction is the direction perpendicular to the main scanning direction; the stencil 11 is paid out in the subscanning direction. A controller, not shown, sends a drive signal to the head 12 and causes the heating elements thereof to selectively generate heat in the main scanning direction.

A stepping motor or similar drive source, not shown, rotates the platen roller 13 stepwise so as to feed the stencil 11 in the subscanning direction. A conveyor roller pair 14 follows the platen roller 13 in the direction in which the stencil 11 is paid out. The roller pair 14 is capable of nipping and conveying the stencil 11, and may be driven by the above stepping motor via a torque limiter, not shown. The roller pair 14 is rotated at a particular speed such that it conveys the stencil 11 at a speed slightly higher than a conveying speed assigned to the platen roller 13. Hence, a tension predetermined by the torque limiter acts on the stencil 11 due to the difference in conveying speed between the roller 13 and the roller pair 14 over the range extending from the position where the stencil 11 contacts the head 12 to the position where it is nipped by the roller pair 14. This prevents the stencil 11 from slackening or creasing at the position where it is pressed against the head 12 by the roller 13. The perforated stencil 11 is cut by a cutter 15 in a predetermined size or length and thereby turns out the master 11. The master 11 is fed in the tangential direction of the drum 2, and has its leading edge clamped by the clamper 2B. In FIG. 4, the cutter 15 is shown as comprising a guillotine made up of a stationary edge located above the stencil transport path, and a movable edge movable toward and away from the stationary edge. The guillotine may be replaced with a cutter having a stationary edge and a rollable edge, if desired.

As shown in FIG. 4, an image reading section 100 is disposed in the upper portion of the printer 1. The reading section 100 has a document scanning portion 101 using a glass platen. Two conveyor roller pairs 102 are positioned at both sides of the glass platen 101 in the intended direction o document feed indicated by an arrow in FIG. 4. A light source 103 illuminates a document P being moved over the glass platen 101. A mirror 105 add a lens 106 steer the resulting reflection from the document P toward a CCD (Charged Coupled Device) image sensor 104. The document P illuminated by the light source 103 is driven out onto a tray 107. The CCD image sensor 104, transforms the incident light to image data, and delivers them to the controller, not shown. The controller executes sequence control necessary for printing and including the control over the head 12 which uses the image data output from the reading section 100.

A master discharging section 30 is located at the other side of the axis of the drum 2, and faces the master making section 10. The section 30 has a pair of belts 32 and 32'. The belt 32 is passed over a lower roller 30A movable toward the drum 2, and a lower roller 30B adjoining a waste master box 31. The belt 32' is passed over upper rollers 30A' and 30B'. When the drum 2 is rotated counterclockwise, the belts 32 and 32' receive the trailing edge of the used master 11 and convey it to the box 31.

A compressing member 33 is located above the box 31, and compresses the master 11 collected in the box 31 so as to prepare a space for receiving the next master 11. When the box 31 is filled up with such waste masters 11, it is taken out of the printer 1 in order to discard the masters 11.

A sheet separator 40 is positioned downstream of the position where the press roller 4 faces the drum 2 with respect to the clockwise rotation of the drum 2. The sheet separator 40 guides the sheet S from the drum 2 to an outlet conveyor 41. The outlet conveyor 41 has endless belts 44 passed over a pair of rollers 42 and 43, and conveys the sheet S separated from the drum 2 to a tray 45. A suction fan 46 is disposed below the belts 44 in order to suck the sheet S onto the belts 44. A table 47 supports the printer 1, and has a bracket 48. The tray 45 is supported by a shaft 49 which is in turn supported by the bracket 48, so that use tray 45 can be lifted about the shaft 49.

Figure 5:
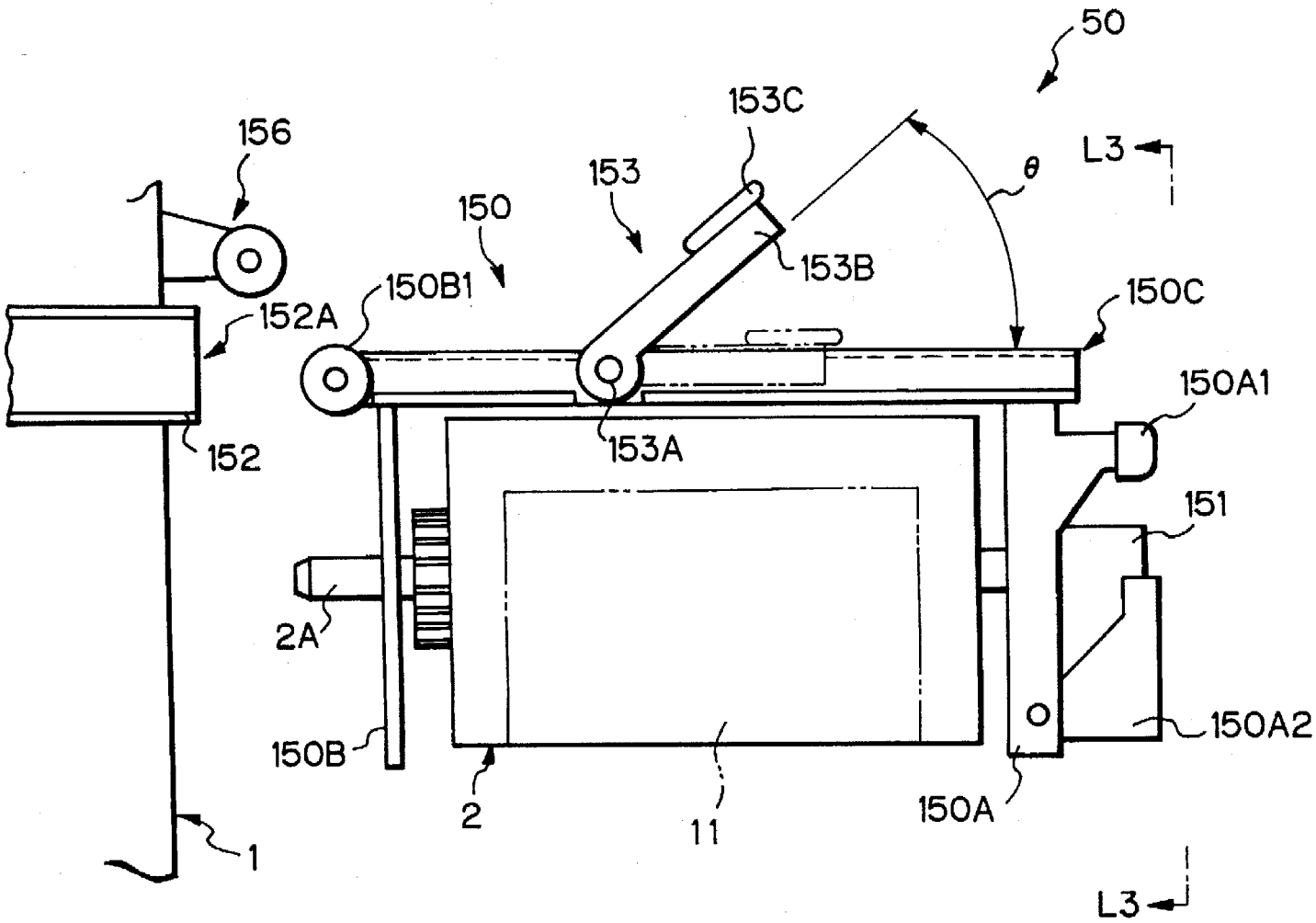
FIG. 5 shows a drum support structure embodying the present invention and applied to the printer of FIG. 5.

As shown in FIG. 4, a drum support structure 50 embodying the present invention is located above the drum 2, but below the reading section 100. As shown in FIG. 5, the support structure 50 has a drum unit 150 which supports the drum 2 rotatably around a center axis of the drum 2. Side plates 150A and 150B extend downward from an engaging member 150C. The drum 2 is journalled to the side plates 150A and 1508 at axially opposite ends thereof. The drum unit 150 resembles a channel facing downward, as viewed in a side elevation, and allows the drum 2 to be moved along the axis thereof between an operative position received in the printer 1 and an inoperative position pulled out of the printer 1. The side plate 150A leads the whole drum unit 150 when the unit 150 is pulled out of the printer 1. In this sense, let the side plates 150A and 150B referred to as a front and a rear side plate, respectively.

The front side plate 150A has a grip 150A1, and a potion 150A2 to be loaded with an ink cartridge 151. When the drum unit 150 is moved to the operative or inoperative position, the grip 150A1 is held by hand. The potion 150A2 is implemented as a bracket rotatably supported by the side plate 150A at its bottom. Hence, the bracket 150A2 can be inclined in order to facilitate the replacement of the cartridge 151. The cartridge 151 is communicated to the ink supply mechanism 3 by a connecting member, not shown.

The engaging member 150C has a length, as measured in the axial direction of the drum 2, great enough to connect the side plates 150A and 150B and greater than the axial length of the drum 2. The engaging member 150C has a width, as measured in the direction perpendicular to the above direction, great enough to accommodate the operator's hand. When the drum 2 has a diameter corresponding to a width capable of accommodating the operator's hand, the length of the engaging member 150C is selected to be substantially equal to or slightly greater than the diameter of the drum 2.

Figure 6:
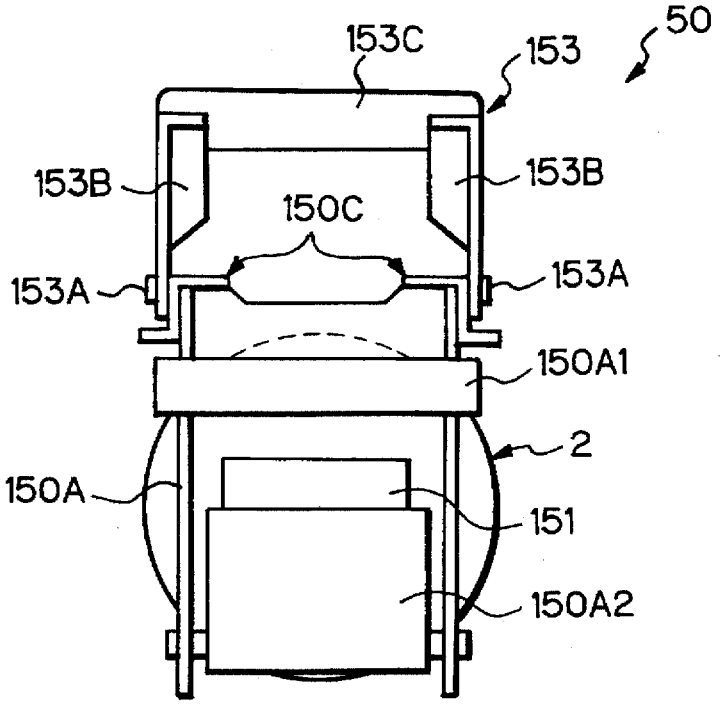
FIG. 6 is z view of a drum unit included in the structure of FIG. 5, as seen in a direction L3—L3.

As shown in FIG. 6, the engaging member 150C is made up of two sheet metal members having a generally Z-shaped cross-section. The sheet metal member are split. The sheet metal members are positioned at the opposite sides of the engaging member 150C in a direction parallel to a diametrical direction of the drum 2, and respectively joined to the upper edges of the side plates 150A and 150B. This successfully reduces the weight of the engaging member 150C. With the above configuration, the engaging member 150C is capable of supporting the drum 2 in a suspended position. As shown in FIG. 5, the printer 1 includes a drum support member 152 capable of receiving the engaging member 150C. The drum support member 152 is comprised of a pair of guide mils affixed to the inner periphery of the printer 1. A pair of rollers 150B1 are mounted on one end of the engaging member 150C in the lengthwise direction and close to the side plate 150B. The rollers 150B1 are rollable in the associated guide rail when the engaging member 150C is moved into or out of the drum support member 152.

Figure 7:
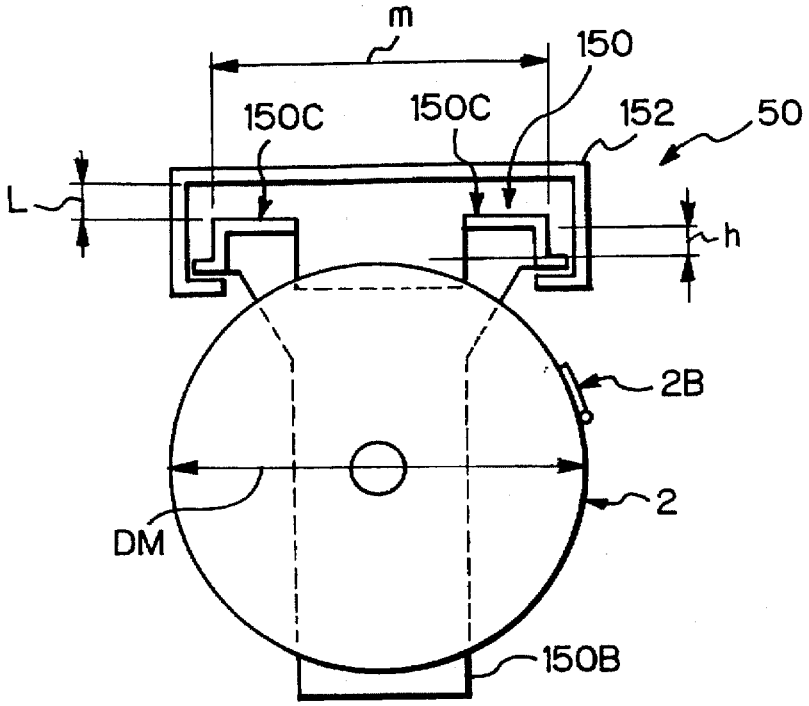
FIG. 7 is a side elevation demonstrating the mechanical nature of the drum unit shown in FIG. 6.

The width of the engaging member 150C is great enough to accommodate the operator's hand and substantially equal to or slightly greater than the diameter of the drum 2, as stated earlier, has the following advantage. As shown in FIG. 7, the member 150C spans substantially the entire diameter of the drum 2. The diameter of be drum 2 and the width of the member 150C ate labeled DM and m, respectively. When the drum 2 tends to swing about the position where it is suspended from the member 150C, the above width m allows the drum 2 to be supported over a broader area than the width ml shown in FIG. 3. This reduces the swinging motion of the drum 2 with ease. In the illustrative embodiment, the width m is selected to be greater than 90 mm inclusive, preferably 100 mm to 150 mm, considering clue fact that at least 80 mm is necessary for the operator's hand to be put under a handle 153 which will be described.

As shown in FIG. 5, the engaging member 150C further includes the above-mentioned handle 153. The handle 153 can be raised away from the member 150C, and hold by hand when the drum unit 150 is carried. Specifically, an axis of rotation perpendicular to the axis of the drum 2 is defined at the center of the member 150C in the lengthwise direction or at a position closer to the printer 1 than the center when the drum unit 150 is pulled out. A shaft 153A extends throughout the engaging member or Z-shaped sheet metal members 150C at the above axis of rotation. A pair of arms 153B are pivoted to opposite ends of the shaft 153A. The free ends of the arms 153B are connected to each other by a grip portion 153C. Hence, the handle 153 has a generally channel-like configuration, as viewed in a plan view.

In the embodiment, the arms 153B are formed of about 1.6 mm thick sheet metal while the grip portion 153c is formed of resin for sure gripping.

When the drum unit 150 is received in the printer 1, the handle 153 is folded down into the top of the engaging member 150C, as indicted by a dash-and-dots line in FIG. 5. When the drum unit 150 is pulled out of the printer 1, the handle 153 may be raised away from the engaging member 150C, as indicated by a solid line in FIG. 5. In the illustrative embodiment, the handle 153 can be raised to an angle θ of 30° to 60° which allows the operator's hand to be put between the grip portion 153C and the engaging member 150C. Each arm 153B has a stop portion at its paroled end for maintaining the handle 153 at the above angle 6. For example, the arm 153B may be provided with a lug at its pivoted end, in which case the engaging member 150C will be provided with a stop. Then, when the arm 153B is raised to the angle θ, the lug will abut against the stop.

The position of the engaging member 150C relative to the surface of the drum 2 is determined, as follows. As shown in FIG. 7, the bottom of the member 150C and the surface of the drum 2 are spaced a distance h having an extremely small value within a range which prevents the clamper 2B of the drum 2 and the member 150C from contacting each other. In this embodiment, the distance h is selected to be less than 10 mm inclusive, preferably almost 0 mm. Hence, the bottom of the member 150C and the drum 2 are extremely close to each other.

The top of the member 150C is spaced a distance L from the inner periphery of the top wall of the guide rail 152 which is built in the printer 1. Because the handle 153 is foldable, the distance L can be reduced, compared to the case wherein such a handle is held stationary in an upright position. In the embodiment, the distance L ranges from 5 mm to 10 mm.

How the drum support structure 50 is operated will be described hereinafter. When the drum unit 150 is to be inserted into the printer 1, the grip 150A1 thereof is held by hand. At this instant, the handle 133 is folded down into the top of the engaging member 150C, i.e., to an inoperative position. Hence, it is not necessary to provide a space between the surface of the drum 2 and the bottom of the handle 153 for accommodating the operator's hand beforehand. This reduces the distance between the drum 2 and the handle 153 to a noticeable degree. Specifically, the distance hi shown in FIGS. 1 and 2, and therefore the overall height of the printer 1 is noticeably reduced.

To pull out the drum unit 130 and carry it, the operator pulls the drum unit 150 out of the printer 1 by holding the grip 150A1. Then, the operator lifts the handle 153 and then puts the operator's hand in the resulting space between the drum unit 150 and the grip portion 153C. In this condition, the operator can carry the drum unit 150 by holding the grip 150A1 and handle 153. Because the handle 153 is foldable into the top of the engaging member 150C, the distance between the top of the member 150C and the drum support member or guide rail 152 can be minimized. This also successfully reduces the distance C shown in FIG. 2 and thereby reduces the overall height of the printer 1.

Moreover, the engaging member 150C supports the drum unit 150 over a broad area, as stated earlier. Hence, when the drum unit 150 is moved into or out of the printer 1, it is prevented from swinging about the unit 150.

Figure 8:
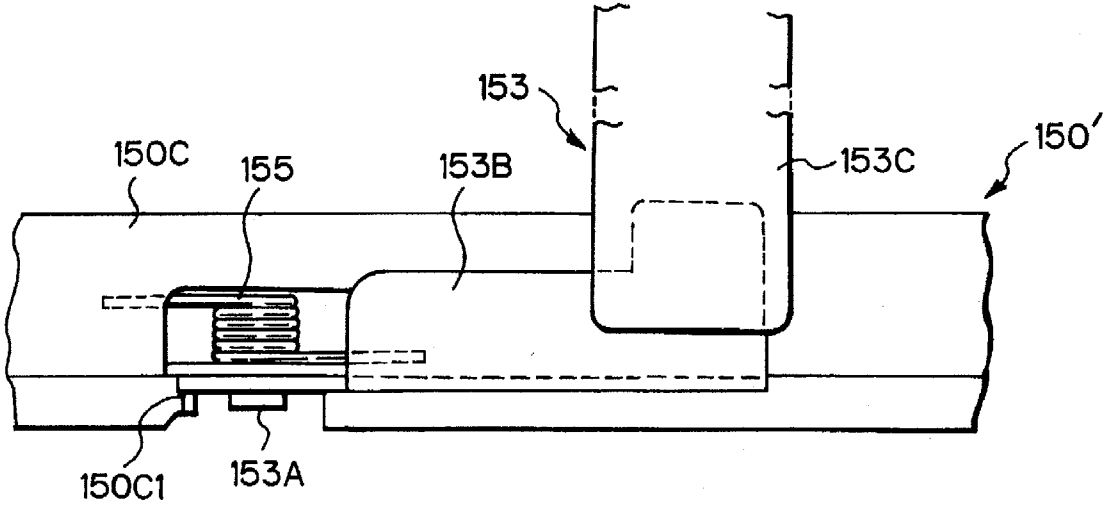
FIG. 8 is a plan view showing a modification of the drum unit of FIG. 5.
Figure 9:
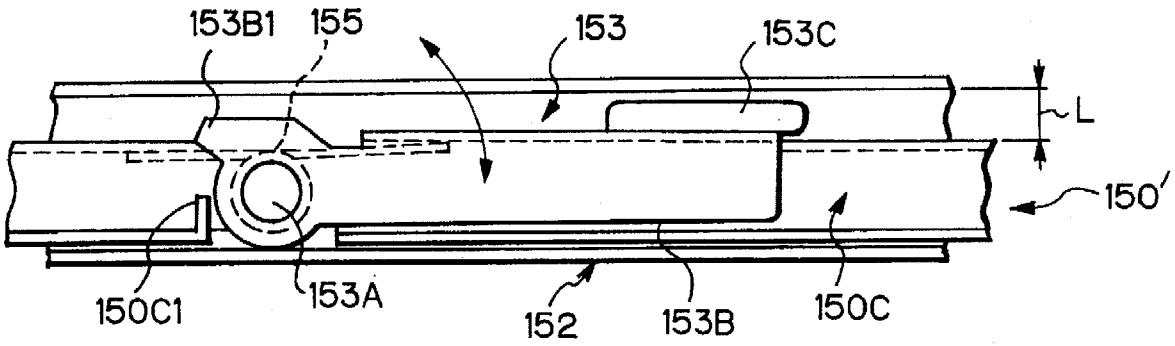
FIG. 9 is a side elevation of the modification shown in FIG. 8.
Figure 10:
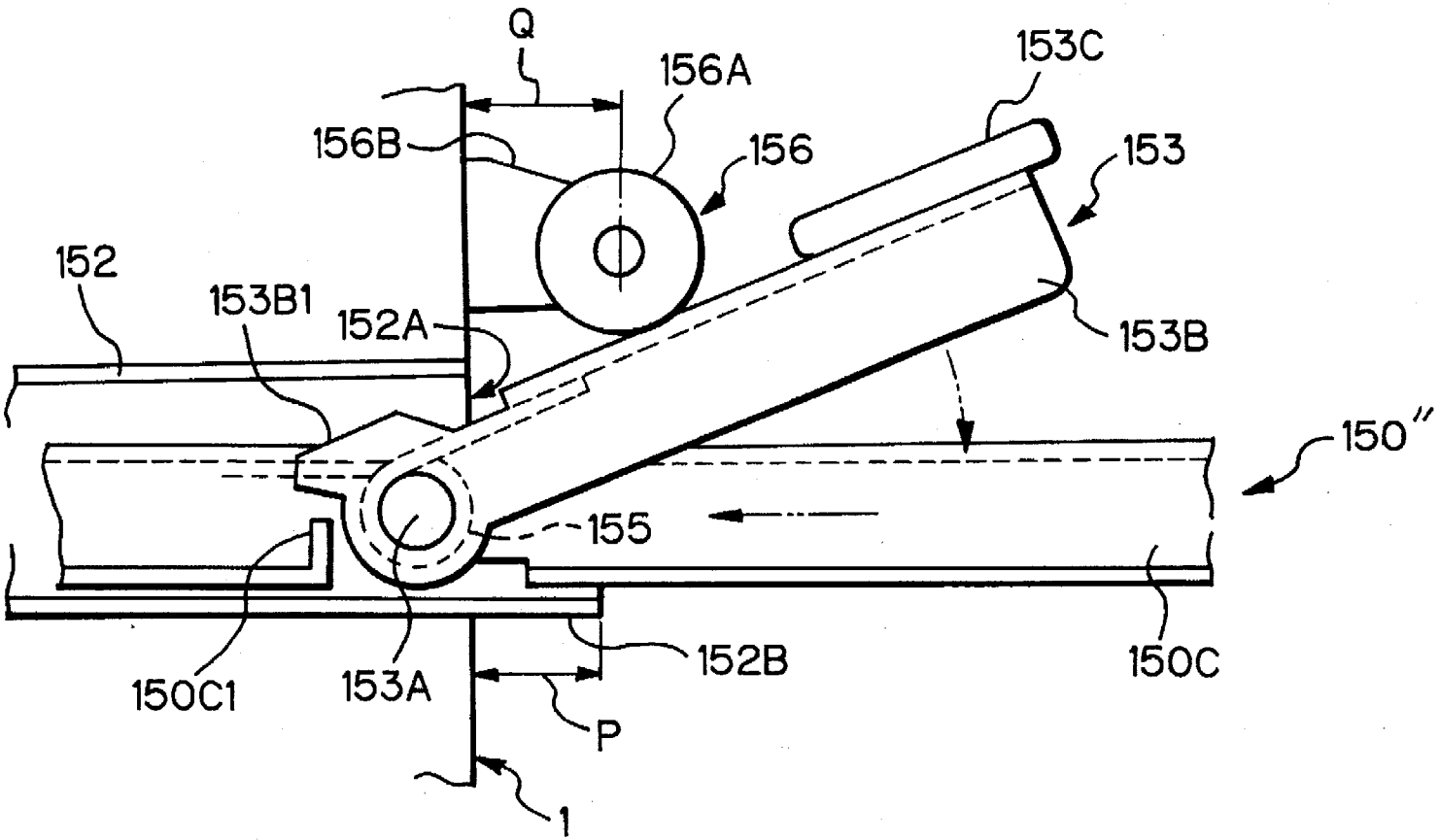
FIG. 10 is a side elevation showing another modification of the drum unit shown in FIG, 5.

Modifications of the chum unit 150 will be described with reference to FIGS. 8–10. In FIGS. 8–10, the same structural elements as the elements shown in FIGS. 4–7 are designated by the same reference numerals, and a detailed description thereof will not be made in order to avoid redundancy. FIGS. 8 and 9 show a modified drum unit 150' having means for biasing the handle 153 toward its raised position. As shown, a coil spring, or resilient member, 155 is wound round the shaft 153A for constantly biasing the handle 153 toward the raised position. The spring 155 is anchored to the arm 153B at one end and to the engaging member 150C at the other end. The engaging member 150C and handle 153 are provided with cooperative positioning portions for maintaining the handle 153 in the raised position under the action of the spring 155. The positioning portions are so configured as to hold the handle 153 at the angle θ of 30° to 60°, as in the previous embodiment. Specifically, a mechanism for holding the handle 153 in the above position is implemented by a locking lug 153B1 formed at the end of the arm 153B, and an engaging lug 150C1 protruding from the engaging member 150C. When the arm 153B is raised, the lug 153B1 abuts against the lug 150C1.

When the chum unit 150' is moved into the printer 1, the handle 153 is folded down into the top of the engaging member 150C against the action of the spring 155. When the drum unit 150' is pulled out of the printer 1, the handle 153 is automatically raised by the spring 155 and held in the raised position by the lugs 153B1 and 150C1. This makes it needless for the operator to raise the handle 153 by hand as in the previous embodiment.

FIG. 10 shows another modified drum unit 150" having an arrangement for automatically folding down the handle 153 when the unit 150' is inserted into the printer 1. As shown, a slide member 156 is mounted on the printer 1 above the drum support member or guide rail 152. The slide member 156 is made up of rollers 156A, and supports 156B supporting the rollers 156A. The rollers 156A are so positioned as to face the handle 153 held in the raised position. The supports 156B protrude from the outer periphery of the printer 1 and support the rollers 156A at its end. Specifically, two rollers 156A are provided and respectively assigned to the two arms 153B.

The distance Q between the roller 156A and the wall of the printer 1 is selected such that when the drum unit 150" is moved into the printer 1, the handle 153 tilts without abutting against be upper edge of an opening 152A formed in the printer 1. If desired, the roller 156A may be provided with a diameter satisfying the above condition. In this modification, the angle θ to which the handle 153 is raised should preferably be less than 90°, more preferably less than 80° inclusive. Such an angle facilitates the insertion of the drum unit 150" into the printer 1.

When the drum unit 150' is inserted into she printer 1, the arms 153B abut against the slide member 156. As a result, the slide member 156 sequentially lays the arms 153B due to the movement of the drum unit 150", as indicated by a dash-and-dots arrow in FIG, 10. Conversely, when the drum unit 150" is pulled out of the printer 1, the handle 153 is caused to sequentially rise by the slide member 156 and the spring 155 as soon as it is brought out of the guide rail 152. This prevents the handle 153 from jumping up and exerting an impact force. In addition, the engaging member 150C is prevented from being caught by the edge of the opening 152A when the drum unit 150" is moved into or out of the printer 1.

As shown in FIG. 10, a tongue 152B protrudes from the lower edge of the guide rail 152 over a distance P. When the drum unit 150" is to be inserted into the printer 1, the lower edge of the engaging member 150 is put on the tongue 152B. Then, the tongue 152B guides the drum unit 150" into the printer 1 and thereby facilitates the insertion of the unit 150".

Figure 11:
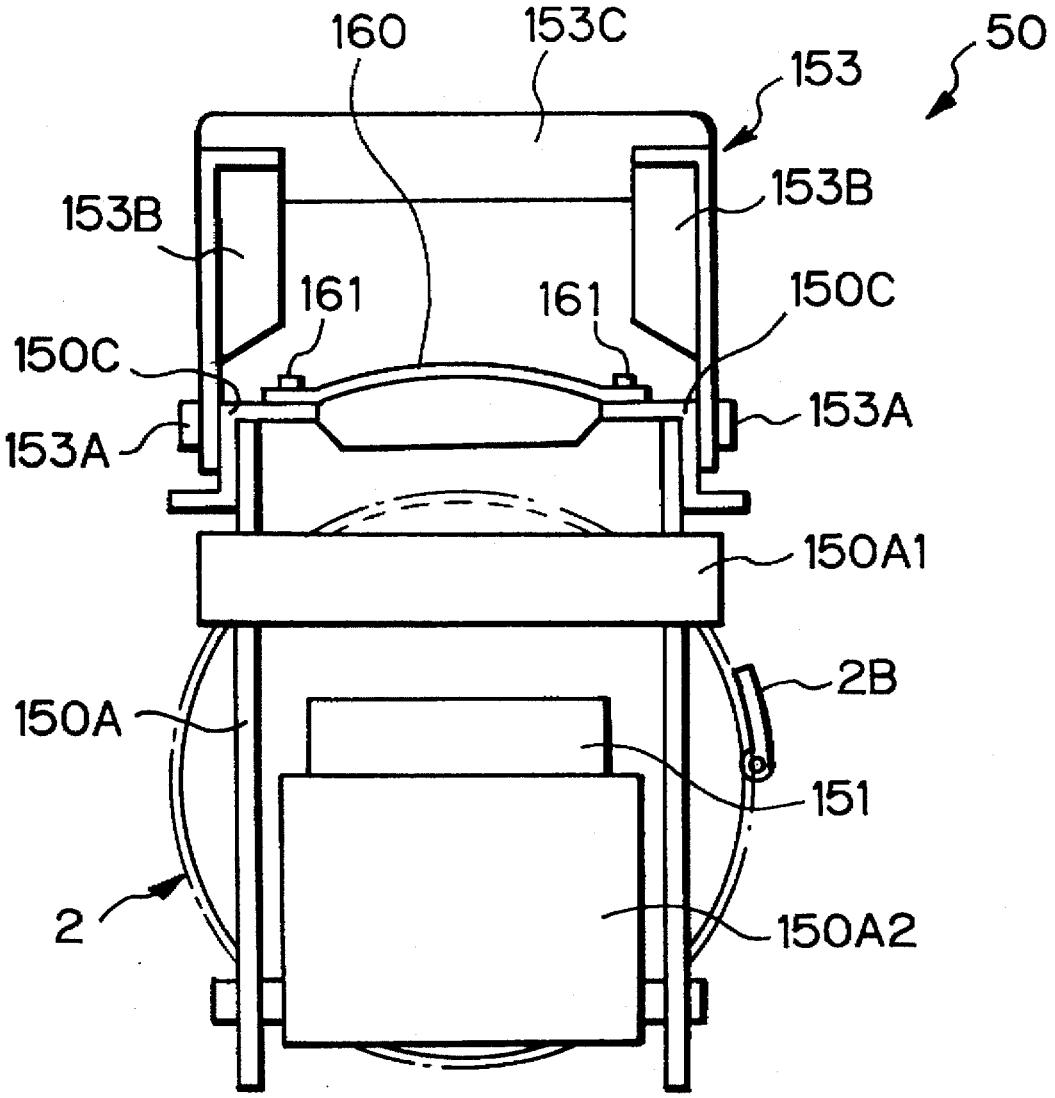
FIG. 11 is a view showing another modification of the drum unit.

Another modification will be described with reference to FIG. 11. When the operator intending to carry the drum unit 150 puts his or her hand between the surface of the drum 2 and the handle 153 and then holds the grip portion 153C, it is likely that the find touches the ink present on the surface of the drum 2. The modification of FIG. 11 includes a cover 160 for protecting the operator's hand from the ink. The cover 160 is positional below the grip portion 153C and implemented as a thin plate fastened to the engaging members 150C by, e.g., bolts 161. It is to be noted that the operator'hand is easily smeared by the ink when the angle θ of the handle 153 shown in FIG. 5 is small.

While the above embodiment and modifications thereof have concentrated on the structure for supporting the drum unit, the present invention is, of course, practicable with any other device movable into and out of the printer, e.g., the master making section which needs maintenance or the master discharging section from which used masters must be taken out.

In summary, it will be seen that the present invention provides a drum support structure for a stencil printer and having various unprecedented advantages, as enumerated below.

(1) A drum unit constituting the support structure has a handle which can be raised when released from a drum support member or can be folded down when coupled with to the drum support member. Hence, the drum unit has a minimum of height when brought to a printing position. This reduces the overall size of the printer.

(2) When the drum unit is pulled out of the printer, the handle is automatically raised by a resilient member. This makes it needless for the operator to raise the handle before carrying the drum unit.

(3) The handle may be raised to a minimum angle necessary for the operator's hand to be put under the handle. This not only reduces the space which the handle occupies in the vertical direction when folded, but also insures the portability of the drum unit when raised.

(4) The handle is so configured as to allow the operator's hand to be put thereunder. Hence, the drum unit is supported over a broad area at its fulcrum, and therefore prevented from swinging easily.

(5) Despite that an engaging portion included in the drum unit has a width great enough for the operator's hand to be inserted, it does not noticeably increase the weight of the drum unit. As a result, the weight of constituent parts used for the miniaturization of the printer is reduced.

(6) When the drum unit is inserted into the printer toward the printing position, a slide member mounted on the printer abuts against the handle and lays it down. Hence, the handle is automatically folded without resorting to manual operation. This successfully miniaturizes the printer with a simple construction and operation.

Various modifications will become possible for those skilled in the art after receiving the teachings of the present disclosure without departing from the scope thereof.

What is claimed is:

1. In a stencil printer apparatus having a body and a drum support structure, the improvement comprising:

a cylindrical drum movable along a center axis thereof between an operative position where said drum is operable to perform stencil printing and an inoperative position where said drum is pulled out of said operative position;

a drum support unit supporting said drum rotatably around said center axis of said drum;

a support member for movably supporting said drum support unit, said support member being mounted on the body of the stencil printer apparatus;

a foldable handle provided on said drum support unit and rotatable about an axis perpendicular to said center axis of said drum; and a slide member mounted on the body of the stencil printer apparatus such that said slide member abuts said handle to fold said handle when said drum is inserted into the stencil printer apparatus.

2. The printer apparatus as claimed in claim 1, wherein said drum support unit is suspended from said support member.

3. The printer apparatus as claimed in claim 1, further comprising a resilient member constantly biasing said handle to a raised position of said handle.

4. The printer apparatus as claimed in claim 1, further comprising an element maintaining said handle at a predetermined angle when said handle is raised.

5. The printer apparatus as claimed in claim 1, wherein said drum support unit has an engaging portion engageable with said support member, said engaging portion having a width at least great enough for an operator's hand to be put in said engaging portion.

6. The printer apparatus as claimed in claim 1, wherein said drum support unit has an engaging portion engageable with said support member, said engaging portion comprising two members separately positioned at opposite ends of said engaging portion in a direction parallel to a diametrical direction of said drum.

7. In a stencil printer apparatus having a body and a drum support structure, the improvement comprising:

a cylindrical drum movable between an operative position where said drum is operable to perform stencil printing and an inoperative position where said drum is pulled out of said operative position;

a drum support unit supporting said drum rotatably around a center axis of said drum;

a foldable handle provided on said drum support unit;

a support member for movably supporting said drum support unit, said support member being mounted on the body of the stencil printer apparatus; and a slide member mounted on the body of the stencil printer apparatus such that said slide member abuts said handle to fold said handle when said drum is inserted into the stencil printer apparatus.

8. In a stencil printer apparatus having a body and a drum support structure, the improvement comprising:

a cylindrical drum movable between an operative position where said drum is operable to perform stencil printing and an inoperative position where said drum is pulled out of said operative position;

a drum support unit supporting said drum rotatably around a center axis of said drum;

a support member for movably supporting said drum support unit, said support member being mounted on the body of the stencil printer apparatus;

a foldable handle provided on said drum support unit, said handle being folded when said drum is inserted into the stencil printer apparatus; and a slide member mounted on the body of the stencil printer apparatus such that said slide member abuts said handle to fold said handle when said drum is inserted into the stencil printer apparatus.

9. In a stencil printer apparatus having a body and a drum support structure, the improvement comprising:

a cylindrical drum movable along a center axis thereof between an operative position where said drum is operable to perform stencil printing and an inoperative position where said drum is pulled out of said operative position;

a drum support unit supporting said drum rotatably around said center axis of said drum;

a support member for movably supporting said drum support unit, said support member being mounted on the body of the stencil printer apparatus;

said drum support unit having an engaging portion engageable with said support member;

a foldable handle provided on said engaging portion and rotatable about an axis perpendicular to said center axis of said drum; and a slide member mounted on the body of the stencil printer apparatus such that said slide member abuts said handle to fold said handle when said drum is inserted into the stencil printer apparatus.

* * * * *